United States Patent [19]

Tsuchida et al.

[11] Patent Number: 4,977,132

[45] Date of Patent: Dec. 11, 1990

[54] HEAT-SENSITIVE RECORD MATERIAL

[75] Inventors: Tetsuo Tsuchida, Takarazuka; Tatsuya Meguro, Nishinomiya; Fumio Seyama, Osaka; Mitsuru Kondo, Hyogo, all of Japan

[73] Assignee: Kanzaki Paper Manufacturing Co., Ltd., Tokyo, Japan

[21] Appl. No.: 370,267

[22] Filed: Jun. 22, 1989

[30] Foreign Application Priority Data

Jun. 29, 1988 [JP] Japan ..... 63-163080

[51] Int. Cl.[5] ..... B41M 5/18

[52] U.S. Cl. ..... 503/220; 427/151; 503/221; 503/225

[58] Field of Search ..... 427/151; 503/204, 220, 503/221, 225

[56] References Cited

U.S. PATENT DOCUMENTS 4,226,912 10/1980 Iwasaki et al. ..... 428/913

FOREIGN PATENT DOCUMENTS 43066 8/1981 Japan ..... 503/220

*Primary Examiner*—Bruce H. Hess

*Attorney, Agent, or Firm*—Morgan & Finnegan

[57] ABSTRACT

The heat-sensitive record material according to this invention has a heat-sensitive recording layer on a base sheet, which comprises a colorless or pale colored basic chromogenic material and a phenolic compound developing a color by contacting with the chromogenic material. The recording layer comprises, as the basic chromogenic material, at least one fluoran derivative represented by the following formula [I] and at least one phthalide derivative represented by the following formula [II] in a weight ratio of 100:1~20;

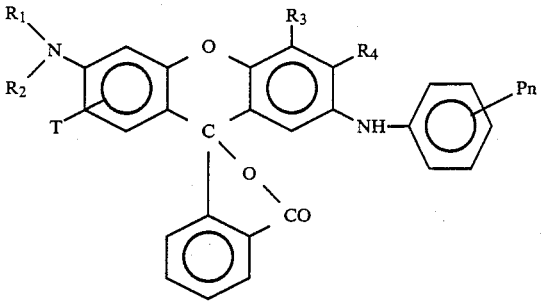

[I]

wherein each $R_1$, $R_2$ represents alkyl, unsaturated alkyl, cycloalkyl, aryl, aralkyl or tetrahydrofurfuryl, each of which may have at least one substituent selected from the group consisting of halogen, alkyl and alkoxyl, $R_1$ may cooperate with $R_2$ to form a ring, each $R_3$, $R_4$ represents hydrogen, alkyl, halogen or alkoxyl, P represents hydrogen, halogen, alkyl, alkoxyl, halogenated alkyl, alkoxycarbonyl or dialkylamino, T represents hydrogen, alkyl or halogen, and n represents an integer of 1 to 4,

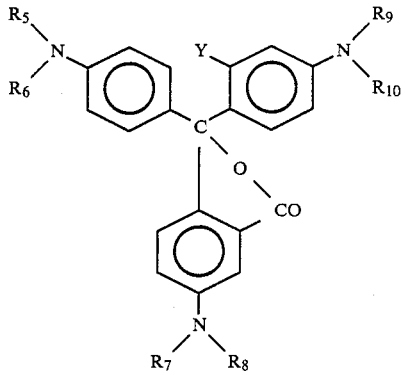

[II]

wherein each $R_5 \sim R_{10}$ represents hydrogen, $C_1 \sim C_6$ alkyl, $C_3 \sim C_6$ unsaturated alkyl, $C_5 \sim C_6$ cycloalkyl, phenyl, $C_7 \sim C_9$ aralkyl or tetrahydrofurfuryl, each of which may have at least one substituent selected from the group consisting of halogen, $C_1 \sim C_2$ alkyl and $C_1 \sim C_3$ alkoxyl, each pair of $R_5$ and $R_6$, $R_7$ and $R_8$, and $R_9$ and $R_{10}$ may cooperate to form pyrrolidino ring, piperidino ring, morpholino ring or hexamethyleneimino ring, and Y represents halogen, $C_1 \sim C_2$ alkyl, $C_1 \sim C_2$ alkoxyl or $C_2 \sim C_3$ acyloxy.

8 Claims, No Drawings

HEAT-SENSITIVE RECORD MATERIAL

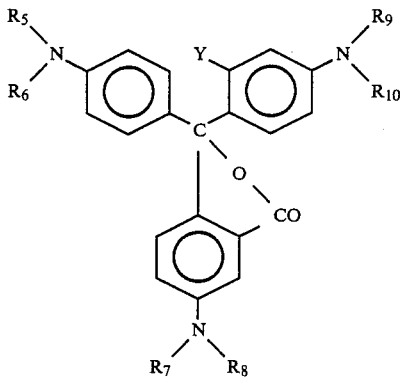

[II]

wherein each $R_5 \sim R_{10}$ represents hydrogen, $C_1 \sim C_6$ alkyl, $C_3 \sim C_6$ unsaturated alkyl, $C_5 \sim C_6$ cycloalkyl, phenyl, $C_7 \sim C_{19}$ aralkyl or tetrahydrofurfuryl, each of which may have at least one substituent selected from the group consisting of halogen, $C_1 \sim C_2$ alkyl and $C_1 \sim C_3$ alkoxyl, each pair of $R_5$ and $R_6$, $R_7$ and $R_8$, and $R_9$ and $R_{10}$ may cooperate to form pyrrolidino ring, piperidino ring, morpholino ring or hexamethyleneimino ring, and Y represents halogen, $C_1 \sim C_2$ alkyl, $C_1 \sim C_2$ alkoxyl or $C_2 \sim C_3$ acyloxy.

BACKGROUND OF THE INVENTION

This invention relates to a heat-sensitive record material and particularly to a heat-sensitive record material which is superior in adaptibility for a high-speed recording and retainability of the developed color images, and further in which the whiteness of the unrecorded portion is stably maintained without undesired coloration and a blue-black or black-blue color superior in stably keeping the recorded images can be developed.

There has been well known heat-sensitive record materials which utilize colorforming reaction between a colorless or pale colored basic chromogenic material and an organic or inorganic color developer, in which the two colorforming materials are thermally brought into contact with each other to produce color images.

Recently, a considerable progress has been made in the field of heat-sensitive recording systems, and hat-sensitive facsimiles, heat-sensitive printers and the like become possible to make the recording speed very higher. In heat-sensitive facsimiles a recording speed of 20 seconds for a sheet of A4 size can be achieved and in heat-sensitive printers a recording speed of 120 letters per second or more can be achieved. With the improvement of hardware fields as described above, it is required for the available heat-sensitive record material to be superior in adaptability for a high-speed recording.

On the other hand, the fields applicable of these heat-sensitive record materials become wider to accompany the rapid spread of heatsensitive facsimiles, heat-sensitive printers and the like. Further, it is required for the recorded images to have various colors. For example, there are increased the cases in which a heat-sensitive record material developing a blue-black or black-blue color is required.

For these requirements, plural basic chromogenic materials each of which develops a different color are mixed to use. However, thus obtained heat-sensitive record materials have some defects, for example, that unnecessary coloration (fogging phenomenon) in the unrecorded white portion easily occurs when they are stored in the condition of a high temperature or high humidity. An improvement of the defects is strongly required.

The object of this invention is to provide a heat-sensitive record material in which the unrecorded white portion can be maintained without undesired coloration when it is stored in the condition of a high temperature or a high humidity for a long time and a stable blue-black or black-blue images can be recorded.

SUMMARY OF THE INVENTION

The heat-sensitive record material according to this invention has a heat-sensitive recording layer on a base sheet, which comprises a colorless or pale colored basic chromogenic material and a phenolic compound developing a color by contacting with the chromogenic material. The recording layer comprises, as the basic chromogenic material, at least one fluoran derivative represented by the following formula [I] and at least one phthalide derivative represented by the following formula [II] in a weight ratio of 100:1 ~ 20;

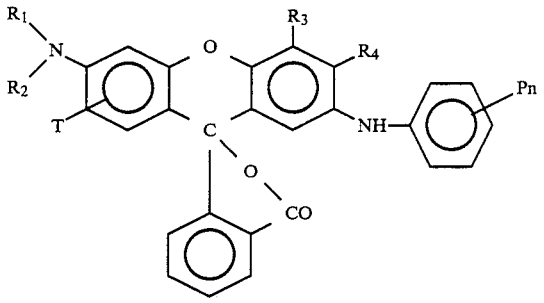

[I]

wherein each $R_1$, $R_2$ represents alkyl, unsaturated alkyl, cycloalkyl, aryl, aralkyl or tetrahydrofurfuryl, each of which may have at least one substituent selected from the group consisting of halogen, alkyl and alkoxyl, $R_1$ may cooperate with $R_2$ to form a ring, each $R_3$, $R_4$ represents hydrogen, alkyl, halogen or alkoxyl, P represents hydrogen, halogen, alkyl, alkoxyl, halogenated alkyl, alkoxycarbonyl or dialkylamino, T represents hydrogen, alkyl or halogen, and n represents an integer of 1 to 4,

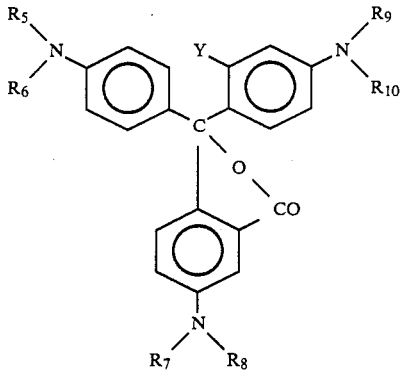

[II]

wherein each $R_5 \sim R_{10}$ represents hydrogen, $C_1 \sim C_6$ alkyl, $C_3 \sim C_6$ unsaturated alkyl, $C_5 \sim C_6$ cycloalkyl, phenyl, $c_7 \sim C_9$ aralkyl or tetrahydrofurfuryl, each of which may have at least one substituent selected from the group consisting of halogen, $C_1 \sim$ alkyl and $C_1 \sim C_3$ alkoxyl, each pair of $R_5$ and $R_6$, $R_7$ and $R_8$, and $R_9$ and $R_{10}$ may cooperate to form pyrrolidino ring, piperidino ring, morpholino ring or hexamethyleneimino ring, and Y represents halogen, $C_1 \sim C_2$ alkyl, $C_1 \sim C_2$ alkoxyl or $C_1 \sim C_3$ acyloxy.

DETAILED DESCRIPTION OF THE INVENTION

According to this invention, heat-sensitive record materials in which the white unrecorded portion is stably maintained without discoloration even though it is exposed in the condition of a high temperature and a high humidity for a long time and the recorded blue-black or black-blue images are also stably maintained can be obtained by using as the basic chromogenic material a specific fluoran derivative together with a specific phthalide derivative within the range of the latter being 1 to 20%, preferably 2 to 10%, by weight of the former.

If the amount of the phthalide derivative is less than 1% by weight of the fluoran derivative, the desired blue-black or black-blue color images can not be obtained. To the contrary, if the amount of the phthalide derivative is more than 20% by weight of the fluoran derivative, the developed color becomes bluish color, and further unnecessary coloration or fogging occurs, in the unrecorded white portion by the influlence of high humidity, high temperature, light and the like so that the value of goods is remarkably lowered.

The available fluoran derivatives represented by the formula [I] according to this invention are a dye which can develop a high density black color by using them alone. As the fluoran derivatives, there are exemplified the following compounds; 3-diethylamino-6-methyl-7-nilinofluoran, 3-diethylamino-6-methyl-7-p-toluidinofluoran, 3-diethylamino-6-methyl-7-xylidinofluoran, 3-diethylamino-6-methyl-7-mesidinofluoran, 3-diethylamino-6-methyl-7-(p-butylanilino)fluoran, 3-diethylamino-6-methyl-7-anisidinofluoran, 3-diethylamino-6-methyl-7-p-phenetidinofluoran, 3-dimethylamino-6-methyl-7-anilinofluoran, 3-dipropylamino-6-methyl-7-anilinofluoran, 3-di(62 -ethoxyethyl)amino-6-methyl-7-anilinofluoran, 3-di(chloroethyl)amino-6-methyl-7-anilinofluoran, 3-dibenzylamino-6-methyl-7anilinofluoran, 3-N-methyl-N-cyclohexylamino-6-methyl-7-amilinofluoran, 3-N-allyl-N-n-pentylamino-6-methyl-7-anilinofluoran, 3-pyrrolidino-6-methyl-7-anilinofluoran, 3-piperidino-6-methyl-7-anilinofluoran, 3-piperidino-6-methyl-7-toluidinofluoran, 3-piperidino-6-methyl-7-(p-butylanilino)fluoran, 3-methylpiperidino-6-methyl-7-(p-butylanilino)fluoran, 3-morpholino-6-methyl-7-(p-butylanilino)fluoran, 3-(N-methyl-anilino)-6-methyl-7-anilinofluoran, 3-(N-ethyl-anilino)-6-methyl-7-anilinofluoran, 3-(N-benzyl-anilino)-6-methyl-7-anilinofluoran, 3-(N-ethyl-p-toluidino)-6-methyl-7-anilinofluoran, 3-(N-ethyl-p-chloroanilino)-6-methyl-7-anilinofluoran, 3-(N-ethyl-anilino)-6-methyl-7-p-toluidinofluoran, 3-(N-ethyl-p-toluidino)-6-methyl-7-p-toluidinofluoran, 3-N-benzylxylidino-6-methyl-7-toluidinofluoran, 3-(N-chloroethyl-p-toluidino)-6-methyl-7-xylidinofluoran, 3-N-ethyl-anilino-6-methyl-7-(p-butylanilino)fluoran, 3-dibutylamino6-methyl7-anilinofluoran, 3-(N-methyl-N-propylamino)-6-methyl-7-anilinofluoran, 3-(N-ethyl-N-isopentylamino)6-methyl-7-anilinofluoran, 3-(N-ethyl-N-n-hexylamino)-6-methyl-7-anilinofluoran, 3-hexamethyleneimino-6-methyl-7-anilinofluoran, 3-(2,3-dihydro-isoindole-2-yl)-6-methyl7-anilinofluoran, 3-diethylamino-6-chloro-7-anilinofluo 3-diethylamino-6-bromo-7-anilinofluoran, 3-(N-ethyl-N-isobutylamino)-6-methyl-7-anilinofluoran, 3-(N-methyl-N-tetrahydrofurfurylamino)-6-methyl-7-anilinofluoran, 3-(N-ethyl-N-tetrahydrofurfurylamino)-6-methyl-7-anilinofluoran, 3-diethylamino-1,6-dimethyl-7-anilinofluoran, 3-diethylamino-4-chloro-6-methyl-7-anilinofluoran, 3-diethylamino-7-(o-chloroanilino)fluoran, 3-dibutylamino)-7-(o-chloroanilino)fluoran, 3-dimethylamino-7-(o-bromoanilino)fluoran, 3-diethylamino-7-(o-methoxycarbonylphenylamino)fluoran, 3-diethylamino-7-[o-(isopentyloxy)carbonylphenylamino]-fluoran, 3-diethylamino-5,6-dimethyl-7-anilinofluoran, 3-diethylamino-5-chloro-6-methyl-7-anilinofluoran, 3-dibutylamino-6-methyl-7-(p-chloroanilino)fluoran, 3-diethylamino-7-(m-trifluoromethylanilino)fluoran, 3-dibutylamino-7-(p-trifluoromethylanilino)fluoran, 3-diethylamino-5-methyl-7-(m-trifluoromethylanilino)-fluoran, 3-diethylamino-5-ethyl-7-(m-trifluoromethylanilino)fluoran, 3-(N-ethyl-N-cyclopentylamino)-6-methyl-7-anilinofluoran, 3-diethylamino-5-chloro-7-(m-trifluoromethylanilino)fluoran and the like.

Among such various fluoran derivatives having a black color developability as described above, the derivatives having the basic skeleton represented by the following formula [III]~[V] is preferably used in this invention, because the heat-sensitive record materials obtained by using these compounds are hardly affected by moisture and temperature so that the unrecorded white portion is stably maintained without undesired coloration.

[III]

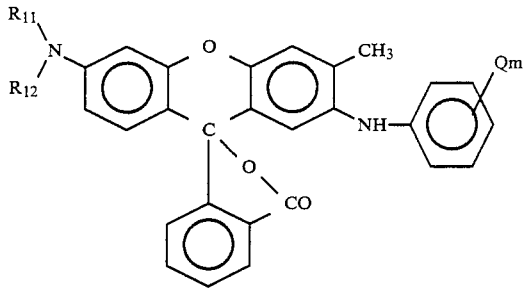

pps wherein each $R_{11}$, $R_{12}$ represents $C_1 \sim C_6$ alkyl, $C_5 \sim C_6$ cycloalkyl, phenyl or tetrahydrofurfuryl, each of which may have at least one substituent seletcted from the group consisting of halogen, $C_1 \sim C_3$ alkyl and $C_1 \sim C_3$ alkoxyl, $R_{11}$ may cooperate with $R_{12}$ to form pyrrolidino ring, piperidino ring, morpholino ring or hexamethyleneimino ring, Q represents hydrogen or methyl, and m represents an integer of 1 to 4.

[IV]

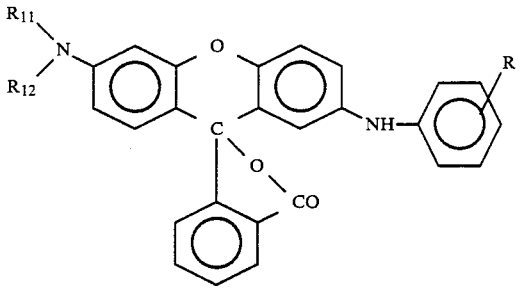

wherein $R_{11}$ and $R_{12}$ have the same meaning as defined hereinbefore, and R represents halogen or halogenated methyl.

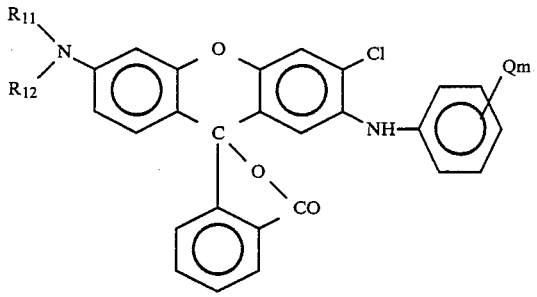

[V]

wherein $R_{11}$, $R_{12}$, Q and m have the same meaning as defined hereinbefore.

The phthalide derivative represented by the above formula [II] which is used together with such a specific fluoran derivative as described above is a dye which can develop a high density blue color by using it alone. As the phthalide derivatives, there are exemplified the following compounds: 3-(4-dimethylaminophenyl)-3-(4-dimethylamino-2-methylphenyl)-6-dimethylaminophthalide, 3-(4-dimethylaminophenyl)-3-(4-diethylamino-2-methylphenyl)-6-dimethylaminophthalide, 3-(4-dimethylaminophenyl)-3-(4-dibutylamino-2-methylphenyl)-6-dimethylaminophthalide, 3-(4-dimethylaminophenyl)-3-(4-diallylamino-2-methylphenyl)-6-dimethylaminophthalide, 3-(4-dimethylaminophenyl)-3-(4-allylamino-2-methylphenyl)-6-dimethylaminophthalide, 3-(4-dimethylaminophenyl)-3-(4-methyl-N-allylamino-2-methylphenyl)-6-dimethylaminophthalide, 3-(4-dimethylaminophenyl)-3-(4-dipropargylamino-2-methylphenyl)-6-dimethylaminophthalide, 3-(4-dimethylaminophenyl)-3-(4-propargylamino-2-methylphenyl)-6-dimethylaminophthalide, 3-(4-dimethylaminophenyl)-3-(4-N-methyl-N-propargylamino-2-methylphenyl)-6-dimethylaminophthalide, 3-(4-dimethylaminophenyl)-3-(4-N-methyl-N-cyclohexylamino-2-methylphenyl)-6-dimethylaminophthalide, 3-(4-dimethylaminophenyl)-3-(4-N-ethyl-p-toluidino-2-methylphenyl)-6-dimethylaminophthalide, 3-(4-dimethylaminophenyl)-3-(4-N-methyl-N-benzylamino-2-methylphenyl)-6-dimethylaminophthalide, 3-(4-dimethylaminophenyl)-3-(4-ethyl-N-tetrahydrofurfurylamino-2-methylphenyl)-6-dimethylaminophthalide, 3-(4-dimethylaminophenyl)3-(4-methyl-N-ethoxymethylamino-2-methylphenyl)-6-dimethylaminophthalide, 3-(4-dimethylaminophenyl)-3-(4-dimethylamino-2-ethylphenyl)6-dimethylaminophthalide, 3-(4-dimethylaminophenyl)-3-(4-diethlamino-2-ethylphenyl)-6-dimethylaminophthalide, 3-(4-dimethylaminophenyl)3-(4-diethylamino-2-methoxyphenyl)-6-dimethylaminophthalide, 3-(4-dimethylaminophenyl)-3-(4-diethylamino-2-ethoxyphenyl)-6-dimethylaminophthalide, 3-(4-dimethylaminophenyl)-3-(4-diethylamino-2-acetoxyphenyl)-6-dimethylaminophthalide, 3-(4-dimethylaminophenyl)-3-(4-diethylamino-2-ethylcarbonyloxyphenyl)-6-dimethylaminophthalide, 3-(4-dimethlaminophenyl)-3-(4-diethylamino-2-chlorophenyl)-6-dimethylaminophthalide, 3-(4-dimethylaminophenyl)-3-(4-diethylamino-2-bromophenyl)6-dimethylaminophthalide, 3-(4-dimethylaminophenyl)-3-(4-diethylamino-2-fluorophenyl)-6-dimethylaminophthalide, 3-(4-dimethylaminophenyl)-3-(4-dimethylamino-2-methylphenyl)-6-diethylaminophthalide, 3-(4-dimethylaminophenyl)-3-(4-diethylamino-2-methylpheyl)-6 -diethylaminophthalide, 3-(4-dimethylaminophenyl)-3-(4-diethylamino-2-methylphenyl)-6-pyrrolidinophthalide, 3-(4-dimethylaminophenyl)-3-(4-diethylamino-2-methylphenyl)-6-piperidinophthalide, 3-(4-diethylaminophenyl)-3-(4-dimethylamino-2-methylphenyl)-6-dimethylaminophthalide, 3-(4-diethylaminophenyl)-3-(4-diethylamino-2-methylphenyl)-6-dimetylaminophthalide, 3-(4-diethylaminphenyl)-3-(4-diethylamino-2-methylphenyl)-6-diethylaminophthalide, 3-(4-dibutylaminophenyl)-3-(4-diethylamino-2-methylphenyl)-6-dimethlaminophthalide, 3-(4-dibutylaminophenyl)-3-(4-diethylamino-2-methylphenyl)-6-dibutylaminophthalide, 3-(4-methyl-N-cyclohexylaminophenyl)-3-(4-diethylamino-2-methylphenyl)-6 -dimethylaminophthalide, 3-(4-ethyl-N-isopentylaminophenyl)-3-(4-diethylamino-2-methylphenyl)-6-dimethylaminophthalide, 3-(4-N-ethyl-N-cyclopentylaminphenyl)-3-(4-diethylamino-2-methylphenyl)-6-dimethylaminophthalide, 3-(4-piperidionophenyl)-3-(4-diethylamino-2-methylphenyl)-6-dimethylaminophthalide, 3-(4-pyrrolidinophenyl)-3-(4-diethylamino-2-methylphenyl)-6-dimethylaminophthalide and the like.

Among the phthalide derivatives having a blue color developability as described above, particularly the compounds represented by the following formula [VI] are preferably used in this invention ,because they are easily manufactured and the heat-sensitive record materials prepared by using them maintain the ground substantially free from fogging,

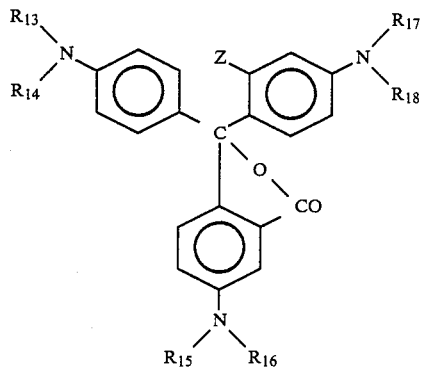

[VI]

wherein each $R_{13} \sim R_{18}$ represents $C_1$–$C_4$ alkyl and Z represents methyl or ethyl.

In the heat-sensitive record material of this invention, the fluoran derivative and the phthalide derivative as defined above are combined to use in a particular proportion. However, various known basic chromogenic materials may be used together with them, if necessary, unless the effect of this invention is inhibited.

As the basic chromogenic materials which may be added, there are exemplified triarylmethaneactone compounds such as 3-(p-dibenzylaminophenyl)-3-(1,2-dimethylindole-3-yl)-7-azaphthalide, 3-(4-diethylamino-2-ethoxyphenyl)-3-(1-ethyl-2-methylindole-3-yl)-7-azaphthalide, 3,3-bis(1-ethyl-2-methylindole-3-yl)phthalide and the like; fluoran compounds such as 3-diethylamino-6-methylfluoran, 3-diethylamino-6-methyl-7-chlorofluoran, 3-(N-ethyl-N-p-tolylamino)-7-methylfluoran, 3-diethylamino-7-methylfluoran, 3-diethylamino-7-chlorofluoran, 3-N-ethyl-N-isopentylamino-7-methylfluoran, 3-cyclohexylamino-6-chlorofluoran, 3-(N-ethyl-N-isopentylamino)-7-methylanilinofluoran, 6-diethylamino-1,2-benzofluoran and the like; spiropyran compounds such as di-β-naphthospiropyran, 3-methyl-di-β-naphthospiropyran and the like; diphenylmethane compounds such as 4,4'-bis-dimethylaminobenzhydrylbenzylether, 4,4'-bis-dimethylaminobenzhydryl-p-toluenesulfinic acid ester and the like; azine compounds such as 3,7-bis(dimethylamino)-10-benzoylphenothiazine, 3,7-bis(diethylamino)-10-benzoylphenoxazine and the like; triarylmethane compounds such as N-butyl-3-[bis(4-N-methylanilino)phenyl)methyl]carbazole and the like.

As phenolic compounds which may be used together with the above basic chromogenic material in the heat-sensitive record material of this invention, there are exemplified such as 4-tert-butylphenol, α-naphthol, β-naphthol, 4-acetylphenol, 4-tert-octylphenol, 4,4'-secbutylidenediphenol, 4-phenylphenol, hydroquinone, 4,4'-dihydroxydiphenylmethane, 4,4'-isopropylidenediphenol, 4,4'-cyclohexylidenediphenol, 4,4'-(1,3-dimethylbutylidene)bisphenol, methyl bis(4-hydroxyphenyl-)acetate, ethyl bis(4-hydroxyphenyl)acetate, n-butyl bis(4-hydroxyphenyl)acetate, benzyl bis (4-hydroxyphenyl)acetate, 4,4'-(p-phenylenediisopropylidene)-diphenyl, 4,4'-(m-phenylenediisopropylidene)diphenyl, 4,4'-dihydroxydiphenylsulfide, 4,4'-thiobis(6-tert-butyl-3-methylphenol), 4,4'-dihydroxydiphenylsulfone, 4-hydroxy-4'-methyldiphenylsulfone, 4-hydroxy-4'-methoxydiphenylsulfone, 4-hydroxy-4'-isopropoxydiphenylsulfone, 4-hydroxy-3',4'-tetramethylenediphenylsulfone, 2,2' -diallyl-4,4'-dihydroxydiphenylsulfone, hydroquinone monobenzyl ether, 4-hydroxybenzophenone, 2,4-dihydroxybenzophenone, 2,4,4'-trihydroxybenzophenone, 2,2'4,4'-tetrahydroxybenzophenone, dimethyl 4-hydroxyphthalate, methyl 4-hydroxybenzoate, ethyl 4-hydroxybenzoate, n-propyl 4-hydroxybenzoate, sec-butyl 4-hydroxybenzoate, n-pentyl 4-hydroxybenzoate, phenyl 4-hydroxybenzoate, benzyl 4-hydroxybenzoate, p-tolyl 4-hydroxybenzoate p-chlorophenyl 4-hydroxybenzoate, 3-phenylpropyl 4-hydroxybenzoate, phenylethyl 4-hydroxybenzoate, p-chlorobenzyl 4-hydroxybenzoate, p-methoxynbenzyl 4-hydroxybenzoate and the like.

The heat-sensitive record material of this invention will be described below in more detail. As the heat-sensitive record materials there have been known verious types as described in Japanese Patent Publications No. 3680 of 1969, No.27880 of 1969, No.14039 of 1970, N43830 of 1973, No.69 of 1974, No.70 of 1974, No.20142 of 1977 and the like. This invention can be applied to each of them to obtain heat-sensitive record materials having such good properties as described above.

In general, the heat-sensitive record material of this invention is manufactured by coating a coating composition, which is prepared by dispersing in a medium comprising a binder dissolved or dispersed therein fine divided particles of the fluoran derivative represented by the formula [I], the phthalide derivative represented by the formula [II] and a phenolic compound, on a substrate such as paper, plastic film, synthetic paper, woven fabric sheet, molding and the like.

The used amount of the basic chromogeic material and phenolic compound in the recording layer is not limited. However, the phenolic compound is generally used within the range of 0.5 to 50 parts by weight, preferably 1.5 to 10 parts by weight, per one part by weight of the chromogenic material.

The coating composition is generally prepared by dispersing simultaneously or separately the chromogenic material and the phenolic compound in an aqueous medium with use of a mixer or pulverizer such as ball mill, attritor, sand mill or the like. The fluoran derivative represented by the formula [I] and the phthalide derivative represented by the formula [II] also may be dispersed simultaneously or separately.

As the binders comprised in the coating composition, there are included starches, hydroxyethylcellulose, methylcellulose, carboxymethylcellulose, gelatin, casein, gum arabic, polyvinyl alcohol, salts of styrene-maleic anhydride copolymer, salts of styrene-acrylic acid copolymer, styrene-butadiene copolymer emulsions and the like. They are used within the range of 10 to 40% by weight on the basis of total solid amount, preferably 15 to 30% by weight.

Further, the coating composition may include various additives such as dispersing agents, e.g., sodium dioctylsulfosuccinate, sodium dodecylbenzenesulfonate, sodium lauryl sulfate and metal salts of fatty acids; ultraviolet ray absorber, e.g., triazole compounds; antifoaming agent; fluorescent dyes; coloring dyes; antioxidant and the like. In the coating composition, a dispersion or emulsion of stearic acid, polyethylene, carnauba wax, paraffin wax, zinc stearate, calcium stearate, ester wax and the like may be added to prevent the sticking generated by the contact between heat-sensitive record material and recording instrument or recording head.

Additionally, there may be added in the coating composition fatty acid amides such as stearic acid amide, N, N'-methylenebis(stearic acid amide), oleic acid amide, palmitic acid amide, coconut aliphatic acid amide and the like; hindered phenols such as 2,2'-methylenebis(4-methyl-6-tert-butylphenol), 1,1,3-tris(2-methyl-4-hydroxy-5-tert-butylphenyl)butan, and the like; ethers such as 1,2-bis(phenoxy)ethane, 1,2-bis(4-methylphenoxy)ethane, 1,2-bis(3-methylphenoxy)ethane, 2-naphthol benzyl ether and the like; esters such as dibenzyl terephthalate, phenyl 1-hydroxy-2-naphthoate and the like; and various known heat-fusible materials, unless the desired effect of this invention is inhibited.

In addition to this, in order to prevent the adhesion of smudges to recording head, there may be added inorganic pigments such as kaolin, clay, talc, calcium carbonate, calcined clay, titanium dioxide, diatom earth, colloidal silica, activated clay and the like.

As the base sheet, there may be used paper, plastic film, synthetic paper, coated paper or wood free paper laminated on plastic film or synthetic paper with an adhesitive, paper laminated with plastic and the like.

The plastic films include such as polyethylene film, polyester film, poly-vinyl chloride film, polystyrene film, Nylon film and the like. As the synthetic paper, there may be used synthetic paper manufactured by such as a film method or a fiber method. The film method includes inner paper method in which synthetic resins, fillers and additives are melted and mixed and then the mixture is extruded to form a film, surface coating method in which a pigment coating layer is formed, surface treating method or the like. The synthetic paper manufactured by a fiber method includes synthetic pulp paper, spanbond paper and the like.

Among them, plastic film or synthetic paper made by film method is preferably used, because particularly excellent advantages of this invention can be obtained with the use of it.

The coating method for producing a recording layer is not limited. The recording layer may be formed by applying a coating composition by a conventional well-know coating method such as bar coating, air-knife coating, rod-blade coating, pure-blade coating, short-dwell coating or the like, and then drying. Further, when a plastic film is used as the base sheet, the coating efficiency can be increased by treating the surface with corona discharging, electron beam irradiation or the like.

The coating amount of the coating composition is not also limited, but it is generally controlled within the range of 2 to 12 g/m$^2$ by dry weight, preferably about 3 to 10 g/m$^2$.

Further, an over coating layer may be formed on the recording layer to protect the recording layer and so on, furthermore, a protect layer may be formed on the back of the base sheet. A under coating layer may be naturally formed on the base sheet, and various know techniques in the field of manufacturing heat-sensitive record materials may be applied.

In the heat-sensitive record materials according to this invention as described above, undesired coloration or fogging phenomenon does not occur in unrecorded white portion an blue-black or black-blue color images free from the fading can be stably developed.

DETAILED DESCRIPTION OF THE PREFERRED EMBODIMENT

The following examples serve to illustrate the invention in more detail although the invention is not limited to the examples. Unless otherwise indicated, parts and % signify parts by weight and % by weight, respectively.

EXAMPLE 1

(1) Preparation of Dispersion A

The following composition was passed through a sand mill.

| | |
|---|---|
| 3-(4-dimethylaminophenyl)-3-(4-diethylamino-2-methylphenyl)-6-dimethylaminophthalide | 0.5 parts |
| 3-(N-ethyl-N-isopentyl)amino-6-methyl-7-anilinofluoran | 10 parts |
| 5% aqueous solution of methylcellulose | 5 parts |
| water | 40 parts |

Pulverization was continued until an average particle size of || m.

(2) Preparation of Dispersion B

The following composition was passed through a sand mill.

| | |
|---|---|
| 4,4'-isopropylidenediphenol | 20 parts |
| 5% aqueous solution of methylcellulose | 5 parts |
| water | 55 parts |

Pulverization was continued until an average particle size of || m.

(3) Preparation of Dispersion C

The following composition was passed through a sand mill.

| | |
|---|---|
| stearic acid amide | 20 Parts |
| 5% aqueous solution of methylcellulose | 5 parts |

-continued

| | |
|---|---|
| water | 55 parts |

Pulverization was continued until an average particle size of || m.

(b 4) Formation of a recording layer 55.5 parts of Dispersion A, 80 parts of Dispersion B, 80 parts of Dispersion C, 15 parts of oxidized silica pigment (oil absorption: 180 ml/100 g), 50 parts of 20% aqueous solution of oxidized starch, 10 parts of water were mixed and stirred. The obtained coating composition was coated on a synthetic paper of 60 g/m$^2$ (Yupo FPG-80 manufactured by Ohji Yuka Kabushiki Kaisha) in the weight of an amount of 5 g/m$^2$ on dry basis, and dried to obtain a heat-sensitive record material.

EXAMPLE 2

A heat-sensitive record material was obtained in the same manner as in Example 1 except that 3-(4-dimethylaminophenyl)-3-(4-dimethylamino-2-methylphenyl)-6-dimethylaminophthalide was used instead of 3-(4-dimethylaminophenyl)-3-(4-diethylamino-2-methylphenyl)-6-dimethylaminophthalide.

EXAMPLE 3

A heat-sensitive record material was obtained in the same manner as in Example 1 except that 3-(4-dimethylaminophenyl)-3-(4-diethylamino-2-ethylphenyl)-6-dimethylaminophthalide was used instead of 3-(4-dimethylaminophenyl)-3-(4-diethylamino-2-methylphenyl)-6-dimethylaminophthalide.

EXAMPLES 4 to 8

Heat-sensitive record materials were obtained in the same manner as in Example 1 except that 3-(4-dimethylaminophenyl)-3-(4-diethylamino-2-methoxyphenyl)-6-dimethylaminophthalide (Example 4), 3-(4-dimethylaminophenyl)-3-(4-diethylamino-2-chlorophenyl)-6-dimethylaminophthalide (Example 5), 3-(4-dimethylaminophenyl)-3-(4-diethylamino-2-acetoxyphenyl)-6-dimethylaminophthalide (Example 6), 3-(4-diethylaminophenyl-3-(4-diethylamino-2-methylphenyl)-6-dimethylaminophthalide (Example 7) or 3-(4-diethylaminophenyl)-3-(4-diethylamono-2-methylphenyl)-6-diethylaminophthalide (Example 8) was used instead of 3-(4-dimethylaminophenyl)-3-(4-diethylamino-2-methylphenyl)-6-dimethyl in the preparation of Dispersion A, respectively.

Examples 9 to 12

Four heat-sensitive record materials were obtained in the same manner as in Example 1 except that 4-hydroxy-4'-isopropoxydiphenylsulfone (Example 9), n-butyl bis(4-hydroxyphenyl)acetate (Example 10), 4,4'-(m-phenylenediisopropylidene)diphenol (Example 11), or 4,4'-(1,3-dimethylbutylidene)bisphenol (Example 12) was used instead of 4,4'-ispropylidenediphenol in the preparation of Dispersion, B, respectively.

EXAMPLES 13 to 17

Five heat-sensitive record materials were obtained in the same manner as in Example 1 except that 3-(N-ethyl-N-cyclohexyl)amino-6-methyl-7-anilinofluoran (Example 13), 3-diethylamino-6-methyl-7-anilinofluoran (Example 14), 3-dibutylamino-6-methyl-7-anilinofluoran (Example 15), 3-dibutylamino-7-(o-chloroanilino)fluoran (Example 16), or 3-diethyl amino- 6-chloro-7-anilinofluoran (Example 17) was used instead of 3-(N-ethyl-N-isopentyl)amino-6-methyl-7-anilinofluoran in the preparation of Dispersion A, respectively.

EXAMPLES 18, 19 and 20

Three heat-sensitive record materials were obtained in the same manner as in Example 1 except that the amount of 3-(4-dimethylaminophenyl-3-(4-diethylamino-2-methylphenyl)-6-dimethylaminophthalide was 0.2 parts (Example 18), 1.0 parts (Example 19) or 1.8 parts (Example 20).

Comparative examples 1 and 2

Heat-sensitive record materials were obtained in the same manner as in Example 1 except that 3,3-bis(4-dimethylaminophenyl)-6-dimethylaminophthalide (Comparative examples 1)or 3,3-bis (4-diethylamino-2-methylphenyl)-6-dimethylaminophthalide (Comparative example 2) was used instead of 3-(4-dimethylaminophenyl)-3-(4-diethylamino-2-methylphenyl)-6-dimethylaminophthalide, respectively.

Comparative examples 3 and 4

Two heat-sensitive record materials were obtained in the same manner as in Example 1 except that the amount of 3-(4-dimethylaminophenyl)-3-(4-diethylamino-2-methylphenyl)-6-dimethylaminophthalide was 0.05 parts (Comparative example 3) or 2.5 parts (Comparative example 4) respectively.

About thus obtained twentyfour heat-sensitive record materials, the developed color and the whiteness-retainability in the background (unrecorded white portion) were examined. The results are shown in Table 1.

The color images were developed by using a heat-sensitive facsimile (HIFAX-700 manufactured by Hitachi Corp.) and the whiteness-retainability in the background was evaluated by measuring the whiteness of the unrecorded white portion with Hunter whiteness meter immediately after the preparation of the heat-sensitive record material, after standing it for 24 hours at 60° C. (thermal resistance) and after standing it for 24 hours in the condition of 40° C. and 90% RH (moisture resistance) respectively.

As shown in Table 1, each of the heat-sensitive record materials according to the present invention may maintains the unrecorded whiteportion substantially free from fogging even if it should be allowed to stand for a long time in the condition of a high temperature and high humidity, and can develop clear blue-black or black-blue color images.

TABLE 1

| | Developed Color | Whiteness in the background (%) after preparation | thermal resistance | moisture resistance |
|---|---|---|---|---|
| Example | | | | |
| 1 | Blue-black | 84.1 | 73.5 | 80.3 |
| 2 | Blue-black | 84.3 | 72.6 | 79.8 |
| 3 | Blue-black | 83.8 | 73.1 | 79.2 |
| 4 | Blue-black | 83.2 | 70.2 | 74.8 |
| 5 | Blue-black | 83.5 | 70.5 | 75.5 |
| 6 | Blue-black | 83.3 | 70.0 | 74.2 |
| 7 | Blue-black | 83.7 | 72.4 | 79.0 |
| 8 | Blue-black | 83.5 | 72.2 | 78.5 |
| 9 | Blue-black | 85.9 | 74.5 | 82.4 |
| 10 | Blue-black | 85.0 | 76.7 | 81.5 |
| 11 | Blue-black | 85.6 | 80.4 | 82.8 |
| 12 | Blue-black | 85.7 | 81.5 | 82.6 |
| 13 | Blue-black | 83.6 | 72.3 | 79.5 |

TABLE 1-continued

| | Developed Color | Whiteness in the background (%) after preparation | thermal resistance | moisture resistance |
|---|---|---|---|---|
| 14 | Blue-black | 83.4 | 72.0 | 79.2 |
| 15 | Blue-black | 84.4 | 75.2 | 80.6 |
| 16 | Blue-black | 84.6 | 75.4 | 80.7 |
| 17 | Blue-black | 84.5 | 75.2 | 80.4 |
| 18 | Blue-black | 84.2 | 73.7 | 80.5 |
| 19 | Black-blue | 83.9 | 73.3 | 80.1 |
| 20 | Black-blue | 82.9 | 68.5 | 72.4 |
| Comparative example | | | | |
| 1 | Blue-black | 80.5 | 49.4 | 65.3 |
| 2 | Blue-black | 78.4 | 45.2 | 61.0 |
| 3 | Red-black | 84.0 | 73.4 | 80.3 |
| 4 | Blue | 81.5 | 63.2 | 68.2 |

What is claimed is:

1. A heat-sensitive record material having a heat-sensitive record layer on a base sheet which comprises a colorless or pale colored basic chromogenic material and a phenolic compound which develops a color by contacting with the chromogenic material, characterized in comprising as the basic chromogenic material at least one fluoran derivative represented by the following formula [I] and at least one phthalide derivative represented by the following formula [II] in a weight ratio of 100:2–18

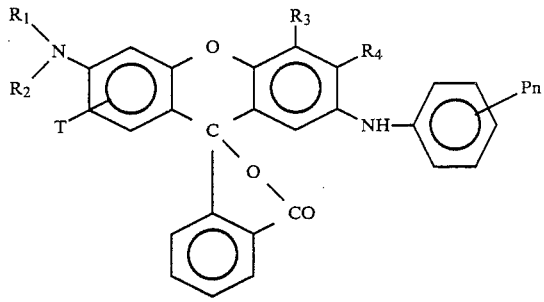

[I]

wherein each $R_1$, $R_2$ represents alkyl, unsaturated alkyl, cycloalkyl, aryl, aralkyl or tetrahydrofurfuryl, each of which have at least one substituent selected from the group consisting of halogen, alkyl and alkoxy, $R_1$ may cooperate with $R_2$ to form a ring, each $R_3$, $R_4$ represents hydrogen, alkyl, halogen or alkoxyl, P represents hydrogen, halogen, alkyl, alkoxyl, halogenated alkyl, alkoxycarbonyl or dialkylamino, T represents hydrogen, alkyl or halogen, and n represents an integer of 1 to 4;

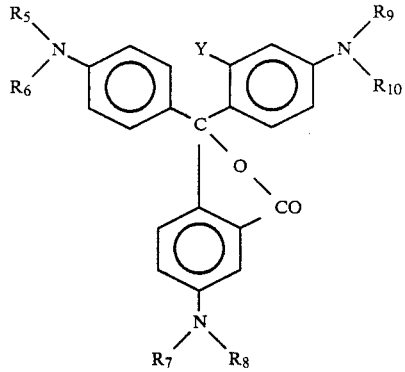

[II]

wherein each $R_5$–$R_{10}$ represents hydrogen, $C_1$–$C_6$ alkyl, $C_3$–$C_6$ unsaturated alkyl, $C_5$–$C_6$ cycloalkyl, phenyl, $C_7$–$C_9$ aralkyl or tetrahydrofurfuryl, each of which may have at least one substituent selected from the group consisting of halogen, $C_1$–$C_2$ alkyl and $C_1$–$C_3$ alkoxyl, each pair of $R_5$ and $R_6$, $R_7$ and $R_8$, and $R_9$ and $R_{10}$ may cooperate to form pyrrolidino ring, piperidino ring, morpholino ring or hexamethyleneimino or $C_2$–$C_3$ acyloxy.

2. A heat sensitive record material as defined in claim 1, wherein the base sheet is a plastic film or a synthetic paper.

3. A heat-sensitive record material as defined in claim 2, wherein the synthetic paper is made by an inner paper method, surface coating method or surface treating method.

4. A heat-sensitive record material as defined in claim 1, wherein the fluoran derivative is a compound represented by the following formula [III];

[III]

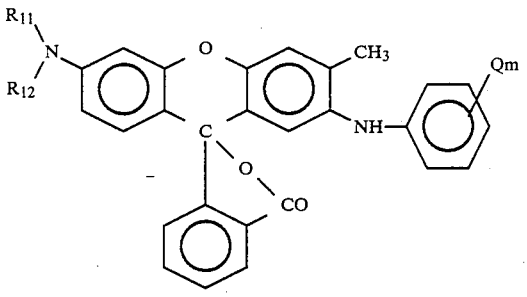

wherein each $R_{11}$, $R_{12}$ represents $C_1 \sim C_6$ alkyl, $C_5 \sim C_6$ cycloalkyl, phenyl or tetrahydrofurfuryl, each of which may have at least one substituent seletcted from the group consisting of halogen, $C_1 \sim C_3$ alkyl and $C_1 \sim C_3$ alkoxy, $R_{11}$ may cooperate with $R_{12}$ to form pyrrolidino ring, piperidino ring, morpholino ring or hexamethyleneimino ring, Q represents hydrogen or methyl, and m represents an integer of 1 to 4.

5. A heat-sensitive record material as defined in claim 1, wherein the fluoran derivative is a compound represented by the following formula [IV];

[IV]

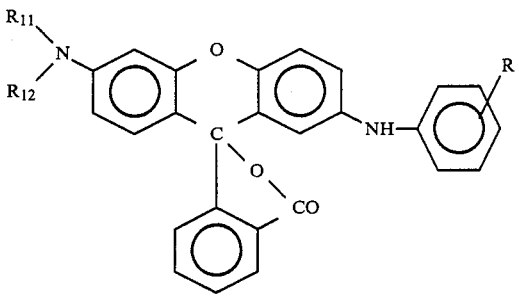

wherein each $R_{11}$, $R_{12}$ has the same meaning as defined hereinbefore and R represents halogen or halogenated methyl.

6. A heat-sensitive record material as defined in claim 1, wherein the fluoran derivative is a compound represented by the following formula [V];

[V]

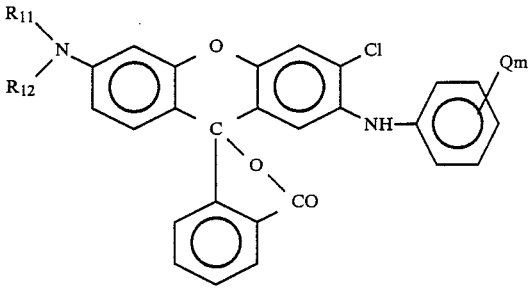

wherein $R_{11}$, $R_{12}$, Q and m have the same meaning as defined hereinbefore.

7. A heat-sensitive record material as defined in claim 1, wherein the phthalide derivative is a compound represented by the following formula [VI];

[VI]

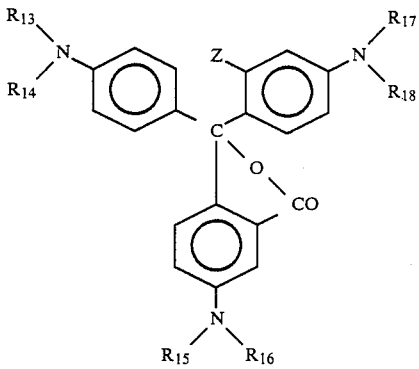

wherein each $R_{13} \sim R_{13}$ represents $C_1$–$C_4$ alkyl and Z represents methyl or ethyl.

8. A heat-sensitive record material as defined in claim 1, wherein said fluoran derivative represented by the formula [I] and said phthalide derivative represented by the formula [II] are comprised in a weight ratio of $100:2 \sim 10$.

* * * * *

UNITED STATES PATENT AND TRADEMARK OFFICE

CERTIFICATE OF CORRECTION

PATENT NO. : 4,977,132

DATED : December 11, 1990

INVENTOR(S) : Tsuchida et al.

It is certified that error appears in the above-indentified patent and that said Letters Patent is hereby corrected as shown below:

Column 3, line 6, correct "$C_1$-$C_3$ acyloxy" to --$C_2$-$C_3$ acyloxy--;

Column 4, line 49, correct "seletcted" to --selected--.

Column 12, line 46 (Claim 1) correct "alkoxy" to --alkoxyl--;

Column 13, line 13 (Claim 1) insert --ring, and Y represents halogen, $C_1$-$C_2$ alkyl, $C_1$-$C_2$ alkoxyl-- after "morpholino ring or hexamethyleneimino";

Column 13, line 50 (Claim 4) correct "seletcted" to --selected--;

Column 13, line 52 (Claim 4) correct "alkoxy" to --alkoxyl--;

Column 14, line 56 (Claim 7) correct "$R_{13}$ - $R_{13}$ represents" to --$R_{13}$ - $R_{18}$ represents--.

Signed and Sealed this

Seventeenth Day of October, 1995

*Attest:*

*Attesting Officer*

BRUCE LEHMAN

*Commissioner of Patents and Trademarks*